US007455474B2

(12) United States Patent
Tievant et al.

(10) Patent No.: US 7,455,474 B2
(45) Date of Patent: Nov. 25, 2008

(54) DEVICE PERMITTING A PLUG OR A COVER TO LOCK IN A DETACHABLE MANNER ONTO A FRAME

(75) Inventors: Philippe Tievant, Parmain (FR); Philippe Dutilleul, Valdampierre (FR)

(73) Assignee: Norinco, Saint Crepin Ibouvillers (FR)

( * ) Notice: Subject to any disclaimer, the term of this patent is extended or adjusted under 35 U.S.C. 154(b) by 253 days.

(21) Appl. No.: 11/284,633

(22) Filed: Nov. 22, 2005

(65) Prior Publication Data

US 2006/0134999 A1 Jun. 22, 2006

(30) Foreign Application Priority Data

Nov. 30, 2004 (FR) ..... 04 12686

(51) Int. Cl.
*F16B 39/00* (2006.01)
*E02D 29/14* (2006.01)

(52) U.S. Cl. ..... 404/25; 52/19; 411/166; 411/197; 411/223; 411/910

(58) Field of Classification Search ..... 404/25, 404/26; 52/19, 20; 411/166, 197, 223, 910
See application file for complete search history.

(56) References Cited

U.S. PATENT DOCUMENTS 2,057,866 A 10/1936 Weber
3,127,807 A * 4/1964 Modrey ..... 411/340
3,519,279 A * 7/1970 Wagner ..... 411/542
4,156,756 A 5/1979 Green
4,298,298 A * 11/1981 Pontone ..... 411/342
4,422,137 A * 12/1983 Watts ..... 362/390
4,723,866 A * 2/1988 McCauley ..... 404/25
4,907,911 A * 3/1990 Rodriguez et al. ..... 405/184.2
5,628,152 A * 5/1997 Bowman ..... 52/20
5,697,729 A * 12/1997 Bowman ..... 404/25
5,788,406 A * 8/1998 Hernandez ..... 404/25
6,007,270 A * 12/1999 Bowman ..... 404/25
6,199,414 B1 * 3/2001 Chang ..... 70/168
6,698,973 B2 * 3/2004 Suatac ..... 404/26

FOREIGN PATENT DOCUMENTS

DE 101 59 121 A1 6/2003

* cited by examiner

*Primary Examiner*—Raymond W Addie
(74) *Attorney, Agent, or Firm*—Ladas & Parry LLP

(57) ABSTRACT

This invention is a device permitting a plug or a cover to lock in a detachable manner onto a frame.

In accordance with the invention, the metal washer (9), interposed between the screw head (4) and the mounting surface (7) formed at the bottom of the housing (5) of the cover (2), includes two radial wings diametrically opposite (9*a*) working together with internal parts (13) of the housing (5) butting and preventing a rotation of the washer (9) during tightening of the fastening screw (3).

The invention has applications for public roadways.

9 Claims, 4 Drawing Sheets

DEVICE PERMITTING A PLUG OR A COVER TO LOCK IN A DETACHABLE MANNER ONTO A FRAME

This invention involves a device permitting a plug or a cover to lock in a detachable manner onto a frame.

Similar devices are known to include fastening screws inserted through the plug's corresponding perforations and to have their threaded ends anchored in threaded holes of the frame. Each fastening screw has its head sunk into a housing emerging from the plug while resting against a flat surface at the bottom of this housing, so as to jam the plug onto the frame by tightening the screws. A waterproof washer made of elastomer, such as rubber, and a metal washer are successively interposed between the flat surface at the bottom of the housing and the screw head.

However, this known locking device has the following disadvantages.

First of all, during tightening of each plug's fastening screw to the frame, the metal washer tends to be rotated by contact with the screw head because of the tightening torque exerted on the screw head, causing a strain hardening of the waterproof washer made of elastomer. Furthermore, using the frame's threaded holes to affix the fastening screws is costly since it is necessary to thread these holes into the frame and, with time, threads can be stripped during repeated actions of unlocking the frame's plug and locking this plug to the frame, which gives rise to maintenance problems leading to increasing costs of such a device.

The purpose of this invention is to eliminate the disadvantages described above by proposing a device permitting a plug or a cover to lock in a detachable manner onto a frame, including at least one fastening screw inserted through a perforation in the plug and having its threaded end anchored to the frame and its head sunk into a housing emerging from the plug while resting against a flat surface at the bottom of this housing so as to jam the plug onto the frame by tightening the screw, a waterproof washer and a metal washer successively interposed between the flat surface and the screw head, and whose distinction is that the metal washer is provided with at least one way of working together with the housing's internal parts to prevent the rotation of the metal washer during tightening of the fastening screw.

The metal washer's anti-rotational direction includes one radial wing.

Preferably, the metal washer would include two radial wings diametrically opposite.

The fastening screw's threaded end is inserted through a perforation of the frame's inside wall and is screwed in a nut confined inside the frame's housing and delimited on the upper end by the frame's inside wall so that the nut is jammed against this wall after the fastening screw is tightened.

Strategically, the internal parts abutting each metal washer's wing consist of the housing's inside surfaces, which are matched up to the wing.

The plug is fastened in a peripheral seating groove in the frame while resting against a metal-on-metal contact without hardly any play in the frame's groove walls by machining the walls' and plug's touching surfaces.

The device includes four fastening screws locking respectively four corners of the plug to the frame.

Strategically, the frame and plug are fastened to one another by fastening screws prior to sealing the frame with concrete in a groove alongside a floor opening to be closed off.

The invention will be better understood, and other purposes, characteristics, details and advantages of this invention will appear more clearly in the descriptive explanation that will follow made in reference to the visual drawings attached, given only as an example to illustrate how to construct the invention and in which.

Figure 1:
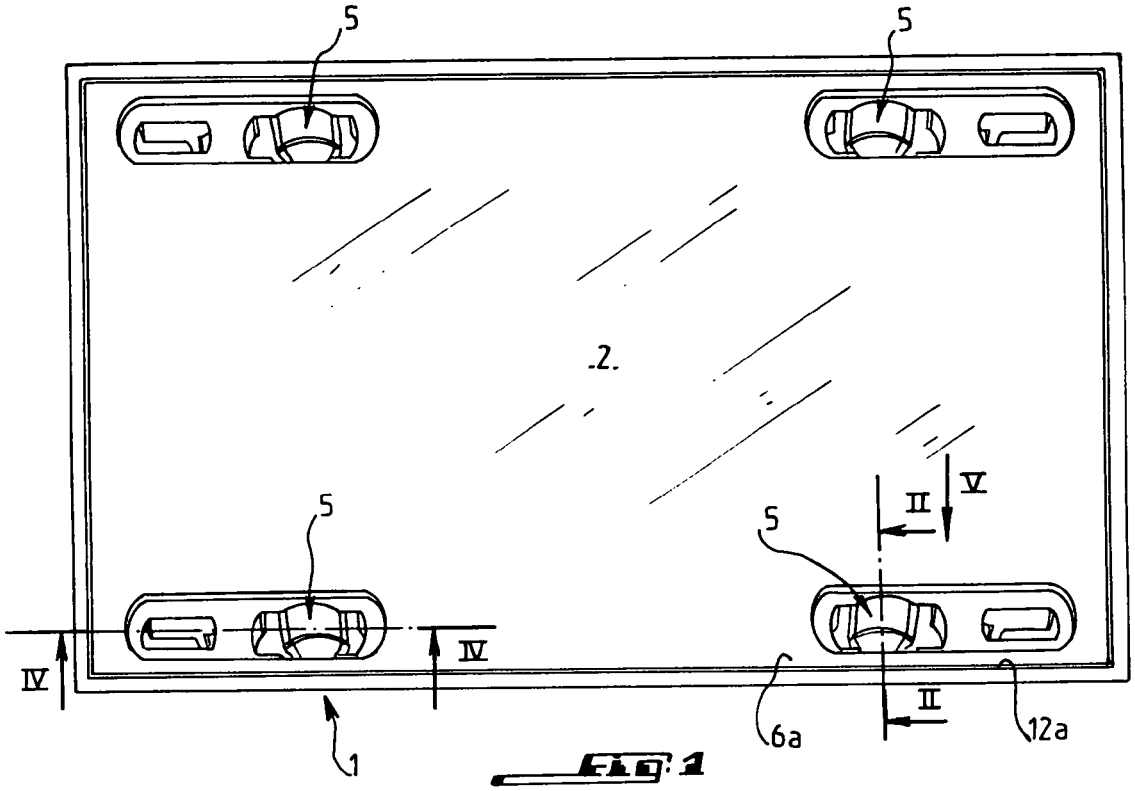
FIG. 1 is a top view of a plug or cover locked to a supporting frame.
Figure 5:
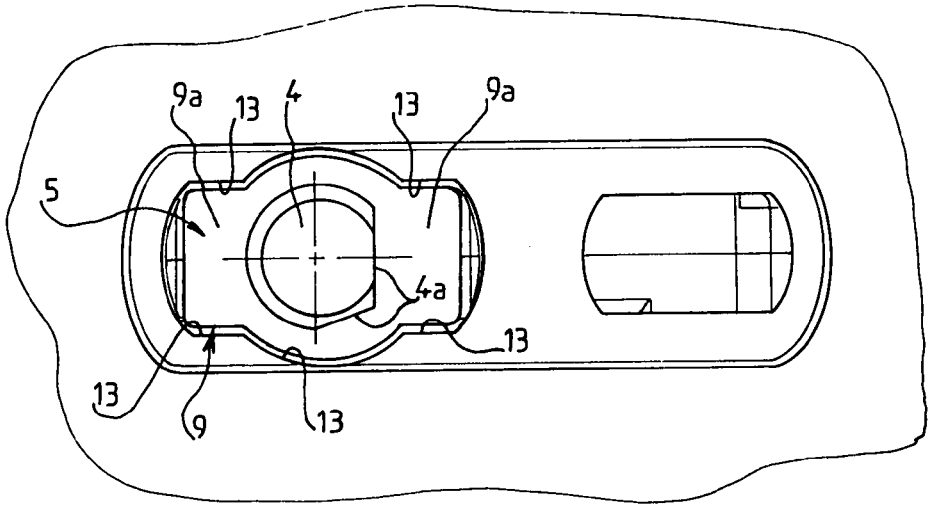
FIG. 5 is a top view following arrow V of FIG. 1.

While referring to the figures, reference 1 designates a frame generally rectangular in shape which can be sunk into the pavement to line up evenly with it and onto which a plug or cover 2 is assembled. In a nonrestrictive way, the frame 1 and cover 2 can be a part of a pavement manhole. Furthermore, the frame 1 can have a circular instead of a rectangular shape.

The cover 2 is fastened in a detachable manner to the frame 1 by fastening screws 3; for example, numbering four while being positioned respectively to four corners of the cover 2.

Each fastening screw 3 has its head 4 sunk in a housing 5 emerging from the outer flat surface 6*a* of the upper wall 6 of the cover 2 so that, preferably, it lines up with the frame in a locked position from cover 2 to frame 1.

In a locking position from cover 2 to frame 1, each screw head 4 is resting against a flat surface 7 from the bottom of the housing 5 of the cover 2 through a waterproof washer made of elastomer 8, such as rubber, resting against a flat surface 7 and a metal washer 9 positioned between washer 8 and screw head 4.

Figure 2:
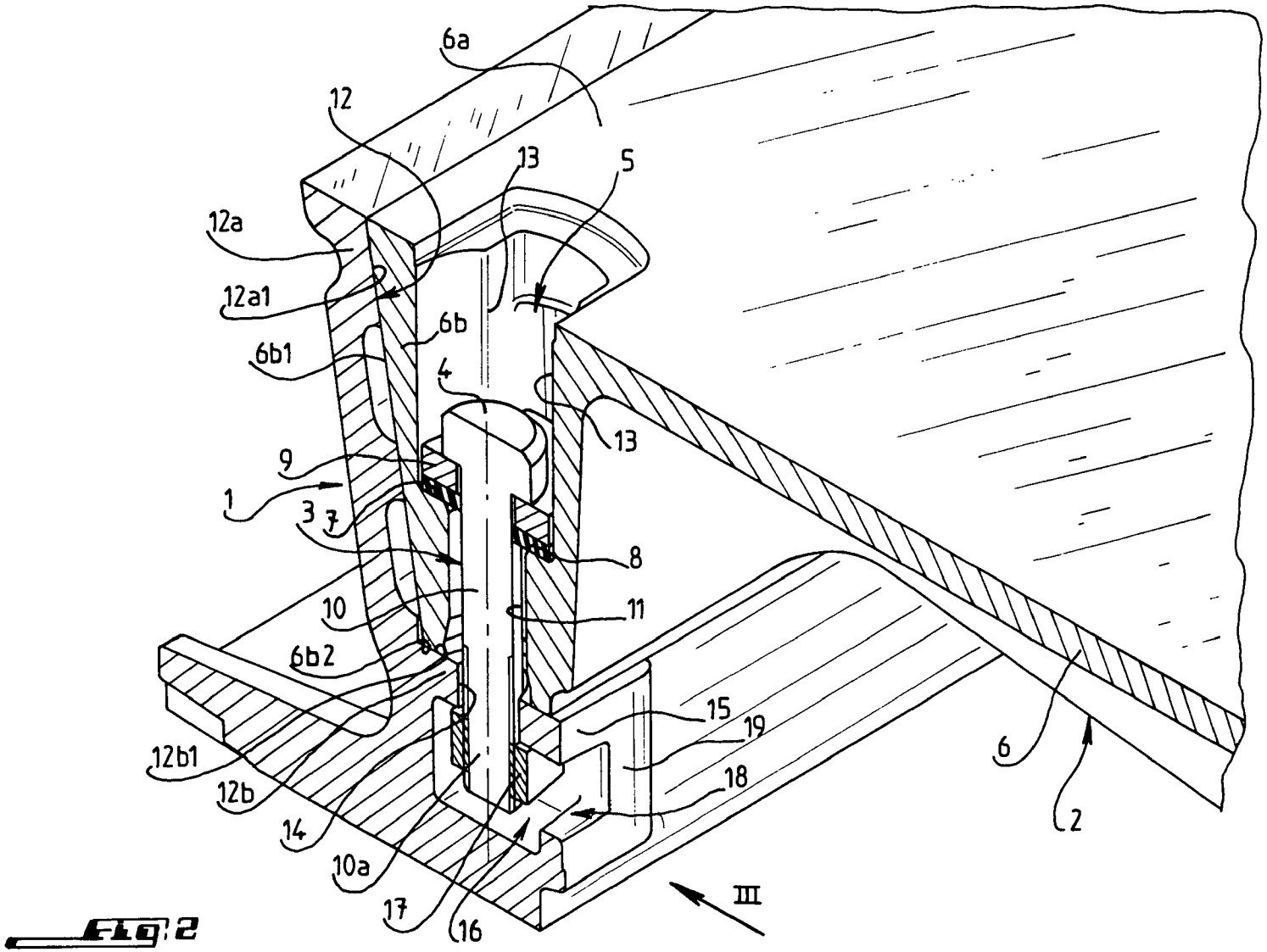
FIG. 2 is a cross-section following line II-II of FIG. 1 and representing the invention device ensuring the locking of the plug to the frame.
Figure 3:
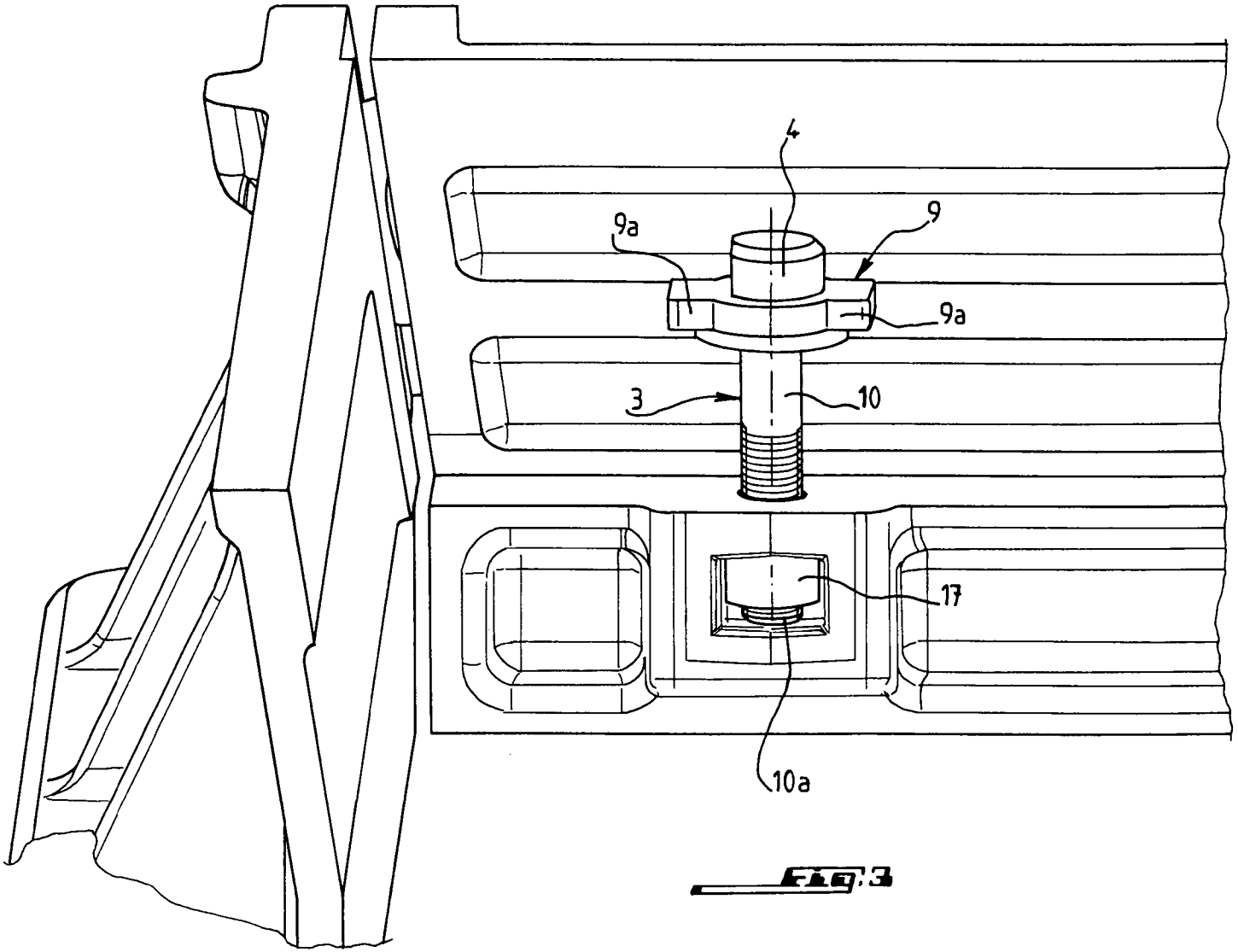
FIG. 3 is a view following arrow III of FIG. 3 without the plug.
Figure 4:
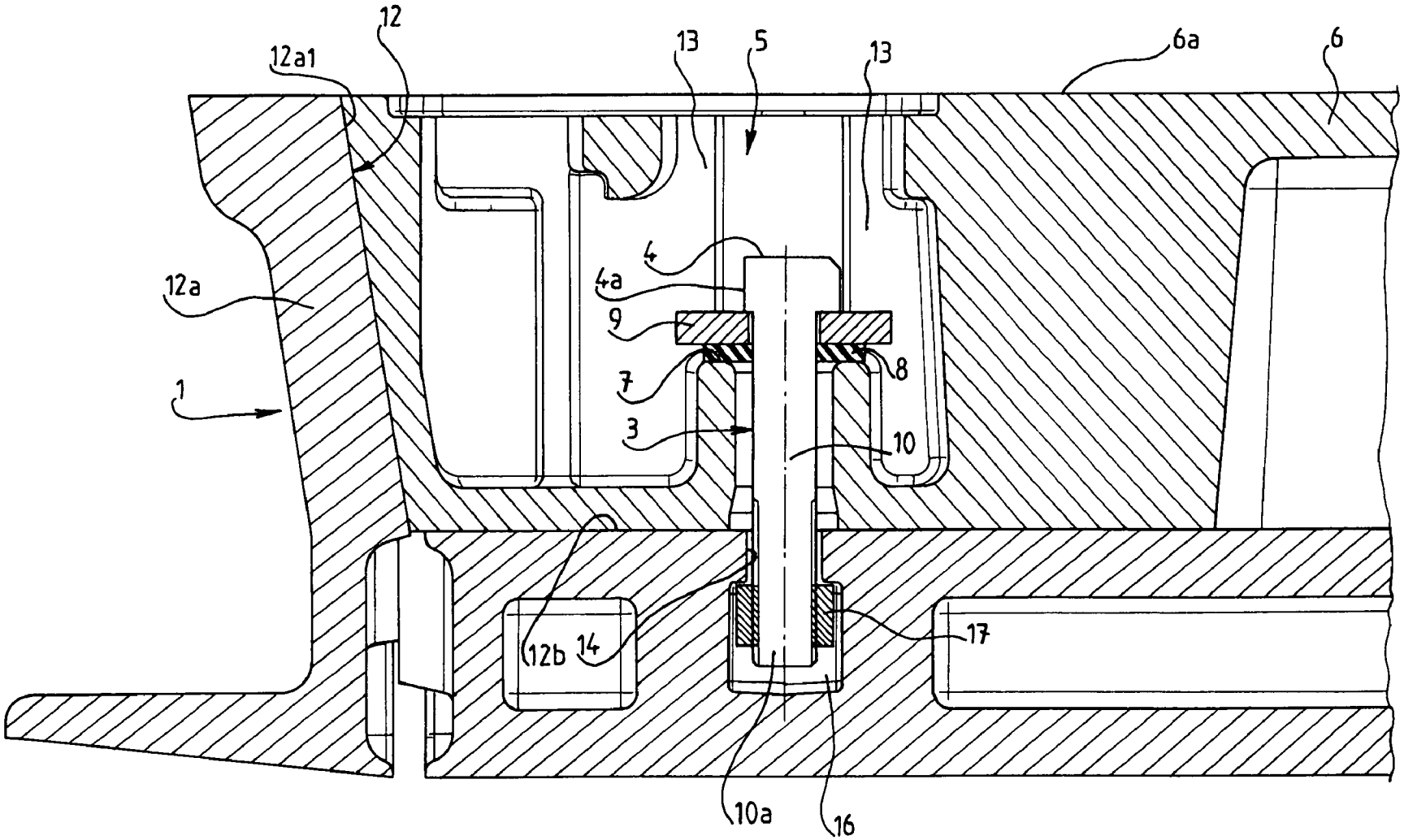
FIG. 4 is a cross-section following line IV-IV of FIG. 1.

The stem 10 of each fastening screw 3 is inserted through the cover's 2 perforation 11 and extends perpendicularly to the upper wall 6 of the cover 2. The threaded end 10*a* of the stem 10 of each fastening screw 3 is anchored to the frame 1 so as to permit each screw 3 to be tightened to jam the cover 2 to the frame 1. As is better illustrated in FIG. 2, the cover 2 is fastened in a peripheral seating groove 12 of the frame 1 while resting against metal-on-metal without hardly any play in the inside surfaces $\mathbf{12}a_1$, $\mathbf{12}b_1$ of the walls 12*a*, 12*b* of the groove 12 by machining the touching surfaces. More precisely, FIG. 2 shows that the side wall 12*a* of the groove 12 of the frame 1 is tilted towards the outside in relation to the perpendicular wall, if the frame 1 is considered sunk in the pavement while its inside wall 12*b* is horizontal in order to receive respectively the tilted outer surface $\mathbf{6}b_1$ of the side wall 6*b* of the cover 2 and the surface at the end $\mathbf{6}b_2$ of the wall 6*b* of the cover 2 in locked position from cover 2 to frame 1, the slanting $\mathbf{12}a_1$, $\mathbf{6}b_1$ and horizontal $\mathbf{12}b_1$ and $\mathbf{6}b_2$ surfaces of the frame 1 and cover 2 machined so that the metal-on-metal contact between them is obtained with an extremely low tolerance, for example, of approximately 0.2 mm.

In accordance with the invention, the metal washer 9 includes two radial wings diametrically opposite 9*a* working together with internal parts abutting the housing 5 to prevent rotation of the metal washer 9 during tightening of the fastening screw 3.

According to a plan for construction of the invention, the internal parts abutting each wing 9*a* of the metal washer 9 consist of at least parallel inside surfaces 13 of the housing 5, positioned on each side of the wing 9*a* near this wing and, preferably, the housing 5 in cross-section is matched up to the washer 9 provided with its two wings 9*a*.

As an alternative, the metal washer's 9 anti-rotation can be ensured by only one wing 9*a* extending in a radial manner to the stem's longitudinal axis from the screw 10 inserted through this washer and working together with two opposite inside surfaces 13 of the housing 5.

The stem 10 of each fastening screw 3 is inserted through a perforation 14 of an inside wall 15 of the frame 1 extending horizontally. Perforation 14 is positioned in a coaxial manner to perforation 11 of the cover 2 when this cover is locked onto the frame 1. The inside wall 15 of the frame 1 has a determined length in a parallel direction to the lateral wall 12*a* of the frame 1 and constitutes an extension of the horizontal peripheral wall 12*b* and on which the cover 2 rests.

The threaded end 10*a* of each fastening screw 3 leads into a cavity or specific housing 16 under the inside wall 15 and is screwed into a nut 17 confined in the housing 16. In the screw's 3 tightened position, the nut 17 rests under the wall 15. The dimensions of the housing 16 defined within the frame 1 are such so that the nut 17 is confined with weak play in this housing in order to allow the blind introduction into this nut of the threaded end 10*a* of the fastening screw 3. The housing 16 emerges inside the frame 1 through a rectangular window 18 made through the frontal wall 19 of the frame 1 delimiting the housing 16, in order to allow, prior to assembly, the introduction of the nut 17 into the housing 16.

During tightening of each fastening screw 3, the metal washer 9, with its wings resting against the corresponding surfaces 13 of the housing 5, is jammed in rotation, preventing as a result the strain hardening of the waterproof washer 8. Furthermore, jamming each fastening screw 3 with the aforementioned nut 17 confined in the chamber 16 reduces manufacturing costs in comparison to using the frame's 1 threaded hole and if threading of the nut 17 should be damaged during repeated actions of disassembling the cover 2 of the frame 1 and assembling of the cover 2 to the frame 1, then simply replacing the nut 17 with another will be sufficient.

Before sealing with concrete the frame in a groove bordering a floor opening to be closed off by the cover 2, this cover is affixed with fastening screws 3 to the frame 1, which makes it possible to ensure a perfect line-up between surfaces in a metal-to-metal contact of the frame 1 and cover 2, and simplifies its installation in the pavement. Plastic caps, not shown here, can at any rate be inserted respectively into emerging housings 5 to plug them up and ensure a seal against contaminants to these housings. To ensure an effective grip of each cap in the corresponding housing, each screw head 4 can include flat sections 4*a* introduced into a matching part of the cap.

The invention claimed is:

1. A cover locking device comprising:

a cover, a frame, at least one fastening screw inserted through a perforation in the cover and wherein the screw has a threaded part anchored to the frame and a head sunk into a housing emerging from the cover while resting against a flat surface at the bottom of the housing in order to jam the cover onto the frame by tightening the screw, a waterproof washer made of an elastomer, and an anti-rotational washer interposed successively between the flat surface and the screw head, wherein the anti-rotational washer is provided with at least one means of abutting internal parts of the housing to prevent a rotation of the anti-rotational washer during tightening of the at least one fastening screw and strain hardening of the waterproof washer located under the anti-rotational washer.

2. Device in accordance with claim 1, wherein the anti-rotational washer has at least one radial wing.

3. Device in accordance with claim 2, wherein the anti-rotational washer-has two diametrically opposed radial wings.

4. Device in accordance with claim 1, wherein the threaded part of the screw is inserted through an opening in an inside wall of the frame and is screwed into a nut confined inside a housing in the frame delimited on an upper end by a wall so that the nut is jammed resting under the wall after tightening of the fastening screw.

5. Device in accordance with claim 2 wherein the internal parts abutting the at least one radial wing comprise an inside surface of the housing of a complementary shape to the shape of the at least one radial wing.

6. Device in accordance with claim 1 wherein the cover is fastened in a peripheral seating groove of the frame.

7. Device in accordance with claim 1, wherein four fastening screws are provided to respectively lock four corners of the cover to the frame.

8. Device in accordance with claim 1, wherein the frame and cover are fastened to one another by said at least one fastening screw prior to sealing the frame with concrete in a groove bordering a floor opening to be closed off.

9. A cover locking device comprising:

a cover, a frame, at least one fastening screw inserted through a perforation in the cover and wherein the screw has a threaded part anchored to the frame and a head sunk into a housing emerging from the cover while resting against a flat surface at the bottom of the housing in order to jam the cover onto the frame by tightening the screw, a waterproof washer made of elastomer, and an anti-rotational washer interposed successively between the flat surface and the screw head, wherein the anti-rotational washer is provided with at least one radial wing of abutting inside a part of the housing of a complementary shape to the shape of the at least one radial wing to prevent a rotation of the anti-rotational washer during tightening of the at least one fastening screw and the strain hardening of the waterproof washer located under the anti-rotational washer.

* * * * *